US008075364B2

(12) United States Patent
Wai et al.

(10) Patent No.: US 8,075,364 B2
(45) Date of Patent: Dec. 13, 2011

(54) STORAGE HOUSING FOR A REMOTE CONTROLLED TOY

(75) Inventors: Chi Pok Billy Wai, Causeway Bay (HK); Kwok Leung Wong, Causeway Bay (HK)

(73) Assignee: Silverlit Limited, Causeway Bay (HK)

( * ) Notice: Subject to any disclaimer, the term of this patent is extended or adjusted under 35 U.S.C. 154(b) by 524 days.

(21) Appl. No.: 12/329,199

(22) Filed: Dec. 5, 2008

(65) Prior Publication Data

US 2010/0144234 A1 Jun. 10, 2010

(51) Int. Cl.
*A63H 33/04* (2006.01)

(52) U.S. Cl. ..... 446/75; 446/78; 446/435; 446/454; 446/456

(58) Field of Classification Search ..... 446/75, 446/76, 77, 78, 429, 454, 456
See application file for complete search history.

(56) References Cited

U.S. PATENT DOCUMENTS

| | | | | |
|---|---|---|---|---|
| 3,363,362 | A * | 1/1968 | Jolley | 446/180 |
| 4,192,093 | A * | 3/1980 | Hamano | 446/427 |
| 4,358,792 | A * | 11/1982 | Domoleczny et al. | 348/789 |
| 4,453,340 | A * | 6/1984 | Kozuka et al. | 446/437 |
| 5,036,951 | A * | 8/1991 | Frangos | 187/214 |
| 5,485,068 | A * | 1/1996 | Vaught | 318/568.1 |
| 5,672,041 | A * | 9/1997 | Ringdahl et al. | 414/545 |
| 6,488,556 | B2 * | 12/2002 | Galomb | 446/73 |
| 6,502,656 | B2 * | 1/2003 | Weiss et al. | 180/168 |
| 6,742,673 | B2 * | 6/2004 | Credle et al. | 221/88 |
| 2002/0132556 | A1 * | 9/2002 | So | 446/456 |
| 2006/0135035 | A1 * | 6/2006 | Leung | 446/456 |
| 2006/0154558 | A1 * | 7/2006 | Rowe et al. | 446/279 |

* cited by examiner

*Primary Examiner* — Gene Kim
*Assistant Examiner* — Joseph B Baldori
(74) *Attorney, Agent, or Firm* — Greenberg Traurig, LLP

(57) ABSTRACT

A storage housing is provided for stowing a remote control toy. The housing comprises a substantially box shaped body with an interior compartment. The compartment has a platform for movement between two positions, and a door for moving between an open and closed position. There is a remote controller for operating the platform and door in a selected manner and also for operating the remote controlled toy. The housing can additionally be part of a vehicle and have wheels.

18 Claims, 18 Drawing Sheets

STORAGE HOUSING FOR A REMOTE CONTROLLED TOY

BACKGROUND

The present disclosure concerns a housing for a remote controlled toy.

The disclosure concerns a remote controlled toy flying object or a remote controlled toy vehicle and a storage housing for that toy. The flying object can, for instance, be a toy helicopter or toy plane and the toy vehicle can be a car generally.

SUMMARY

A storage housing is provided for stowing a remote control toy flying object or remote controlled vehicle. The housing comprises a substantially box shaped body with an interior compartment. The compartment has a platform for movement between two positions, and a door for moving between an open and closed position. There is a remote controller for operating the platform and the door in a selected manner and also for operating the toy flying object or toy vehicle. The housing can be part of a vehicle which can have wheels.

DRAWINGS

The features and objects of the present disclosure will become more apparent with reference to the following description taken in conjunction with the accompanying drawings wherein like reference numerals denote like elements and in which.

DETAILED DESCRIPTION

Figure 1:
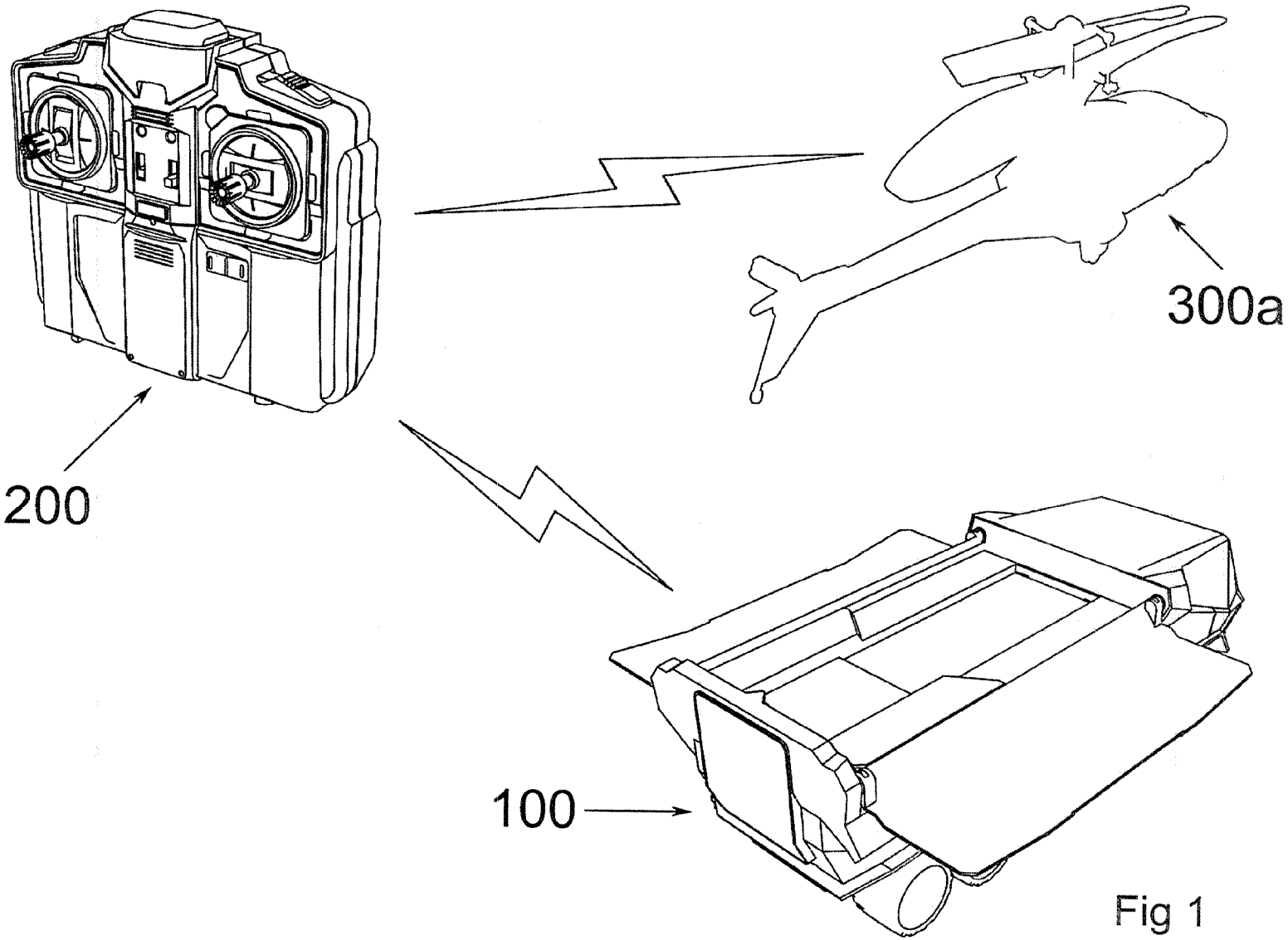
FIG. 1 is a system showing an embodiment of the housing, remote control and toy flying object in accordance with the present disclosure.
Figure 2:
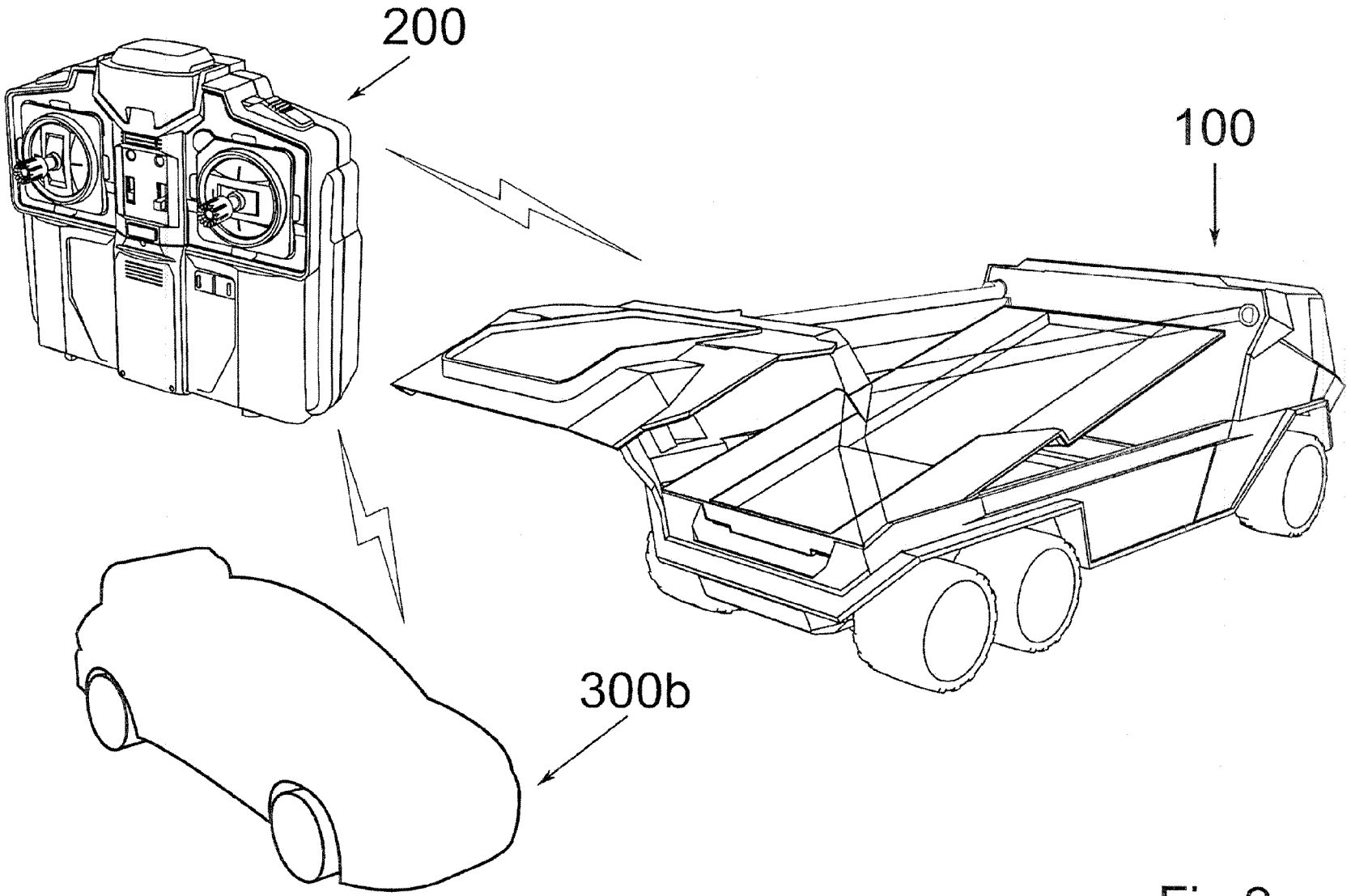
FIG. 2 is a system showing an embodiment of the housing, remote control and remote control toy vehicle in accordance with the present disclosure.
Figure 3:
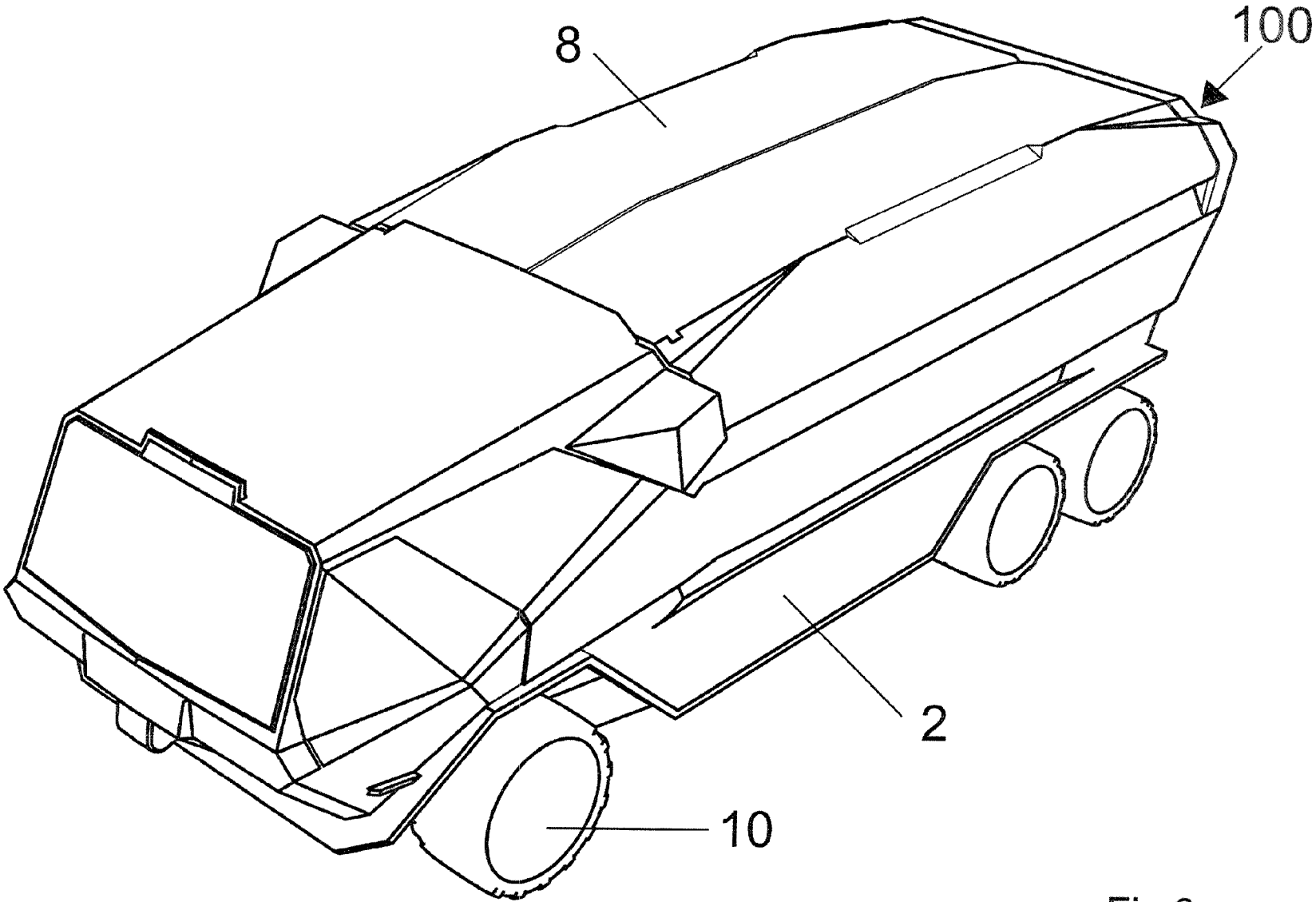
FIG. 3 is a perspective view of an embodiment of the housing for a remote controlled toy in accordance with the present disclosure.
Figure 4:
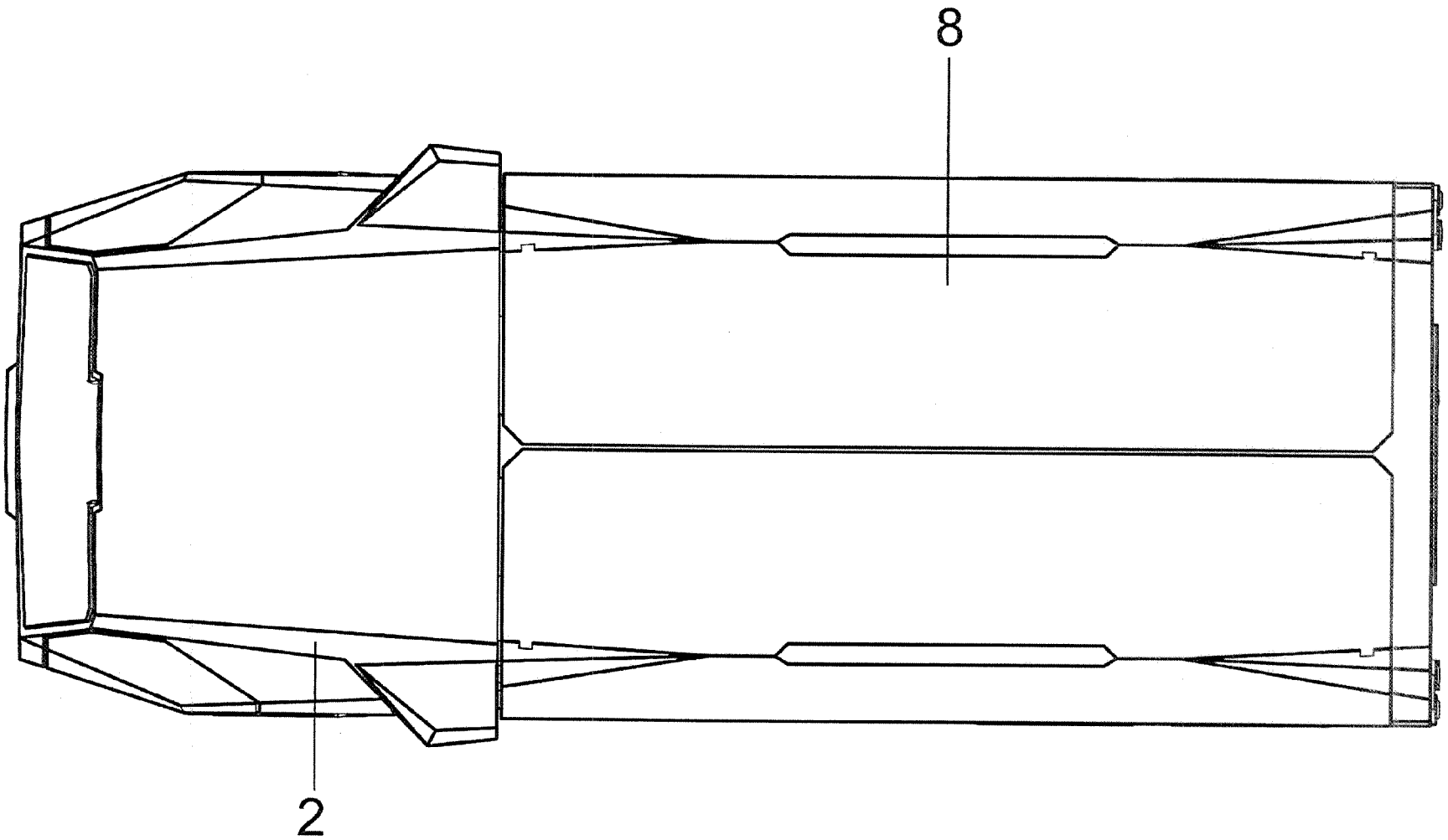
FIG. 4 is a top view of an embodiment of the housing for a remote controlled toy in accordance with the present disclosure.
Figure 5:
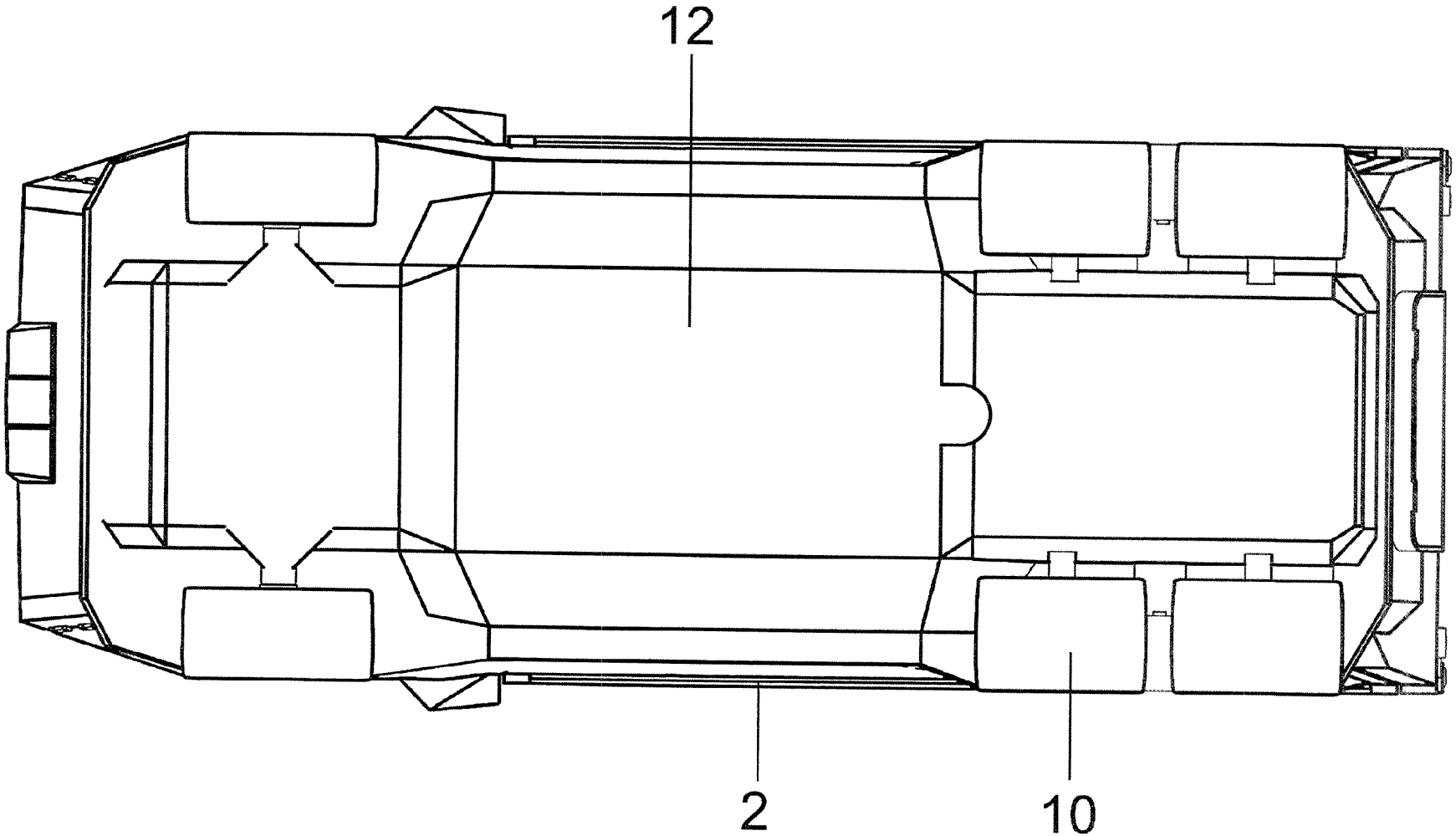
FIG. 5 is a bottom view of an embodiment of the housing for a remote controlled toy in accordance with the present disclosure.
Figure 6:
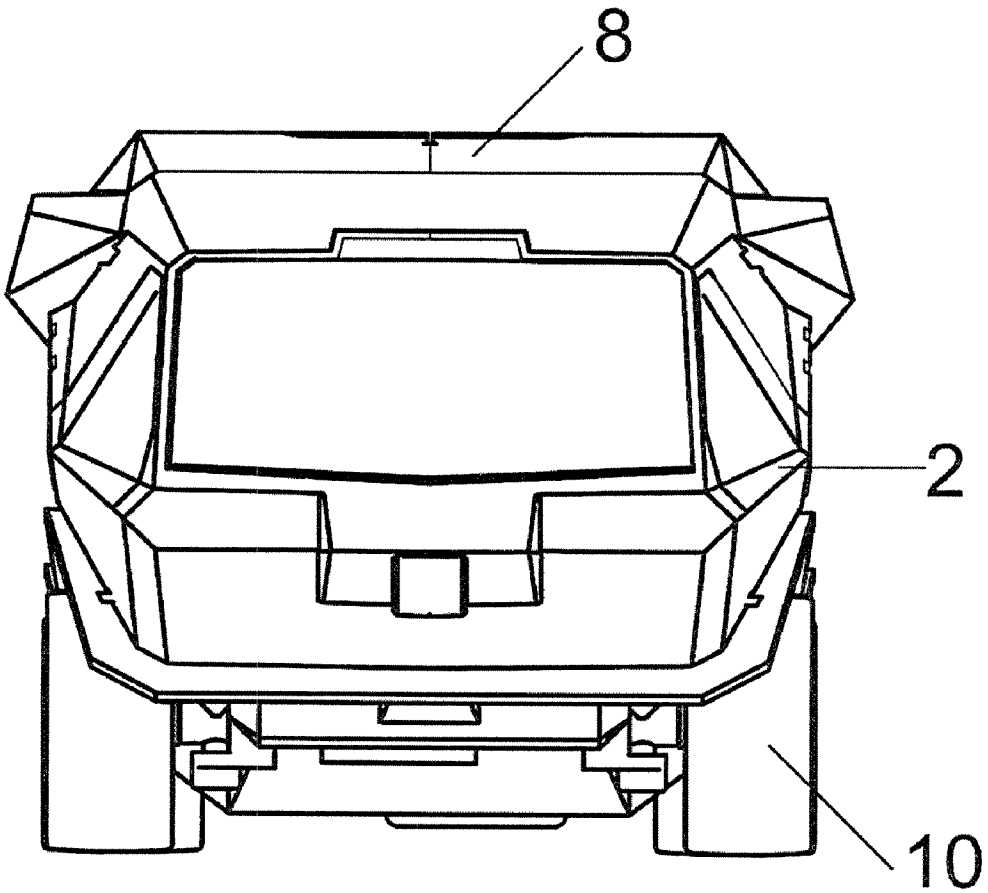
FIG. 6 is a front view of an embodiment of the housing for a remote controlled toy in accordance with the present disclosure.
Figure 7:
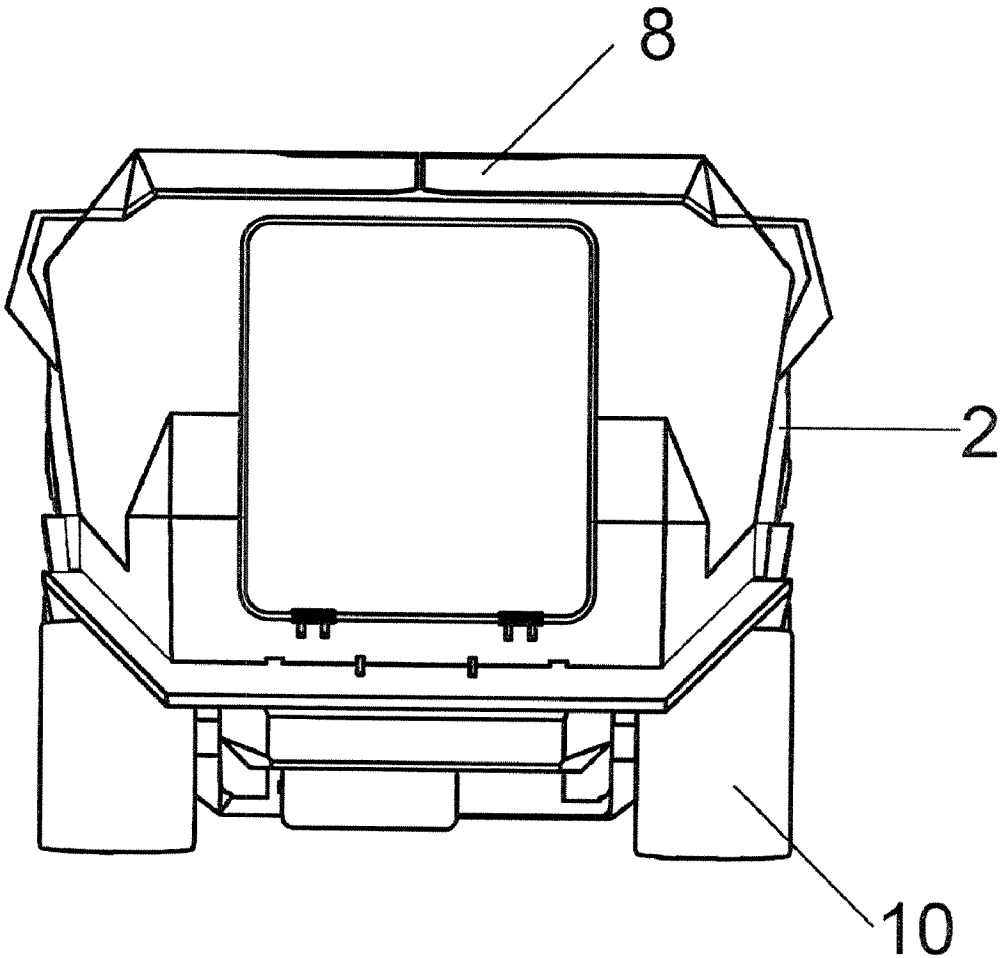
FIG. 7 is a back view of an embodiment of the housing for a remote controlled toy in accordance with the present disclosure.
Figure 8:
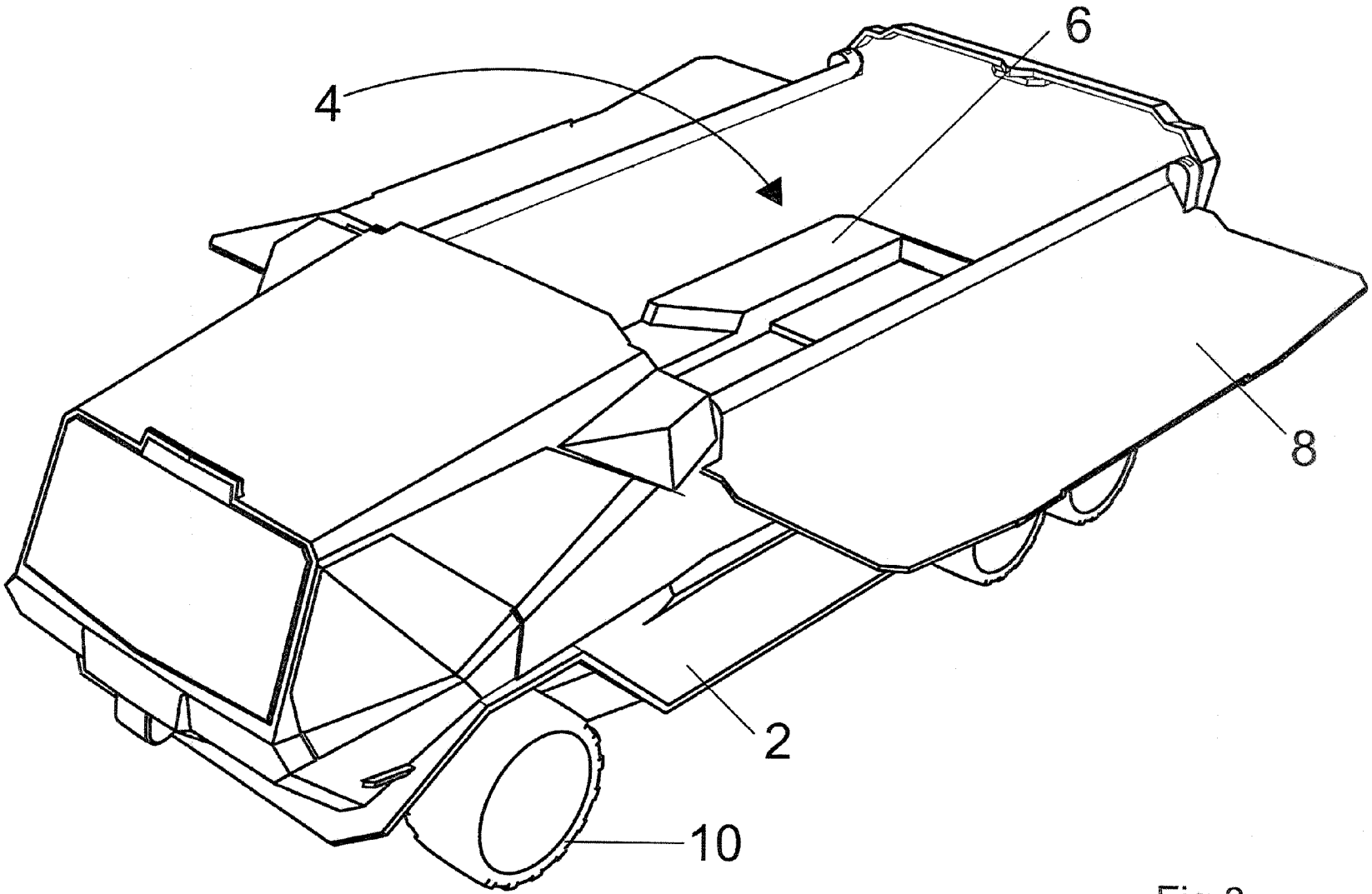
FIG. 8 is a perspective view of an embodiment of the housing for a remote controlled toy in accordance with the present disclosure.
Figure 9:
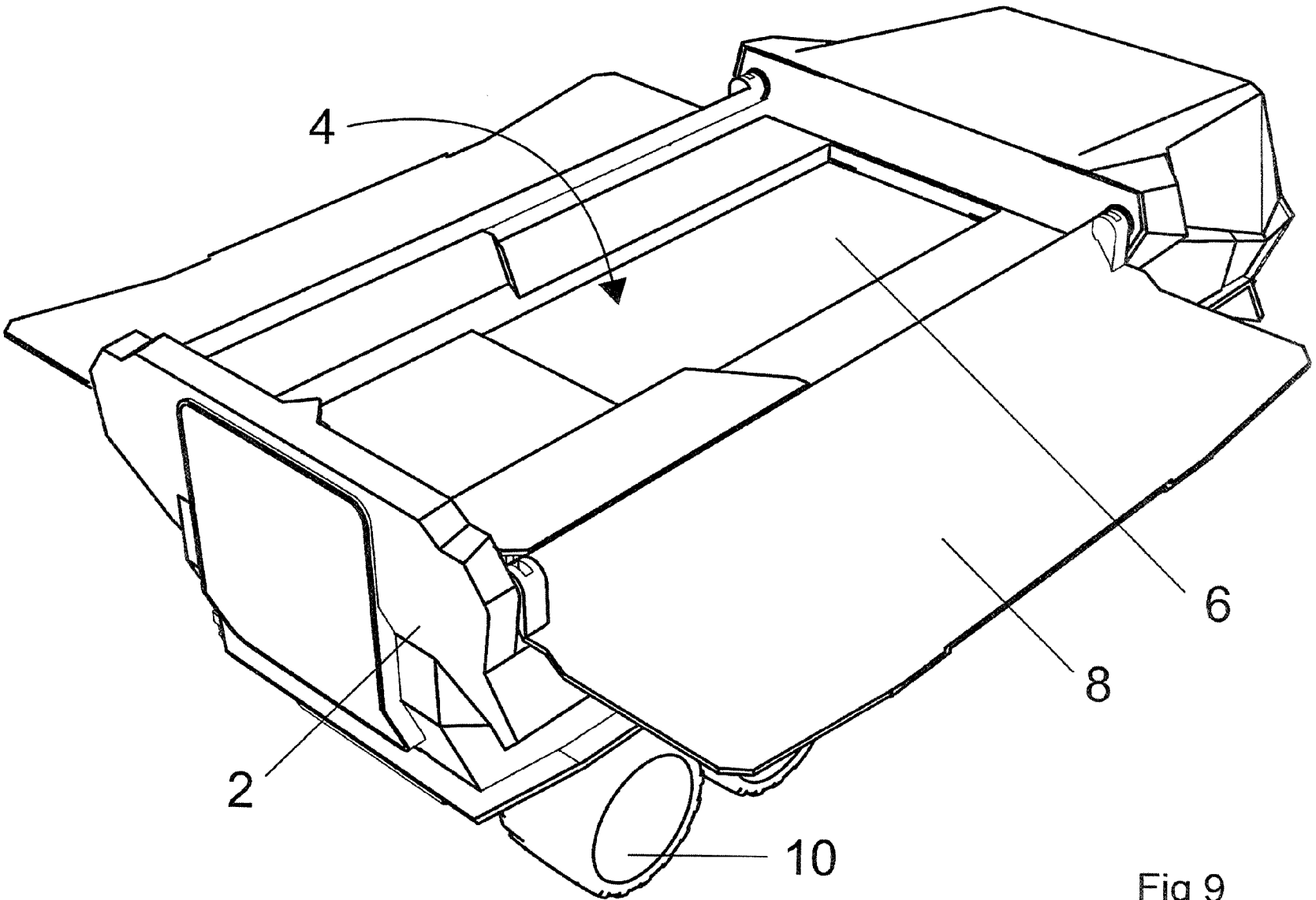
FIG. 9 is a perspective view of an embodiment of the housing for a remote controlled toy in accordance with the present disclosure.
Figure 10:
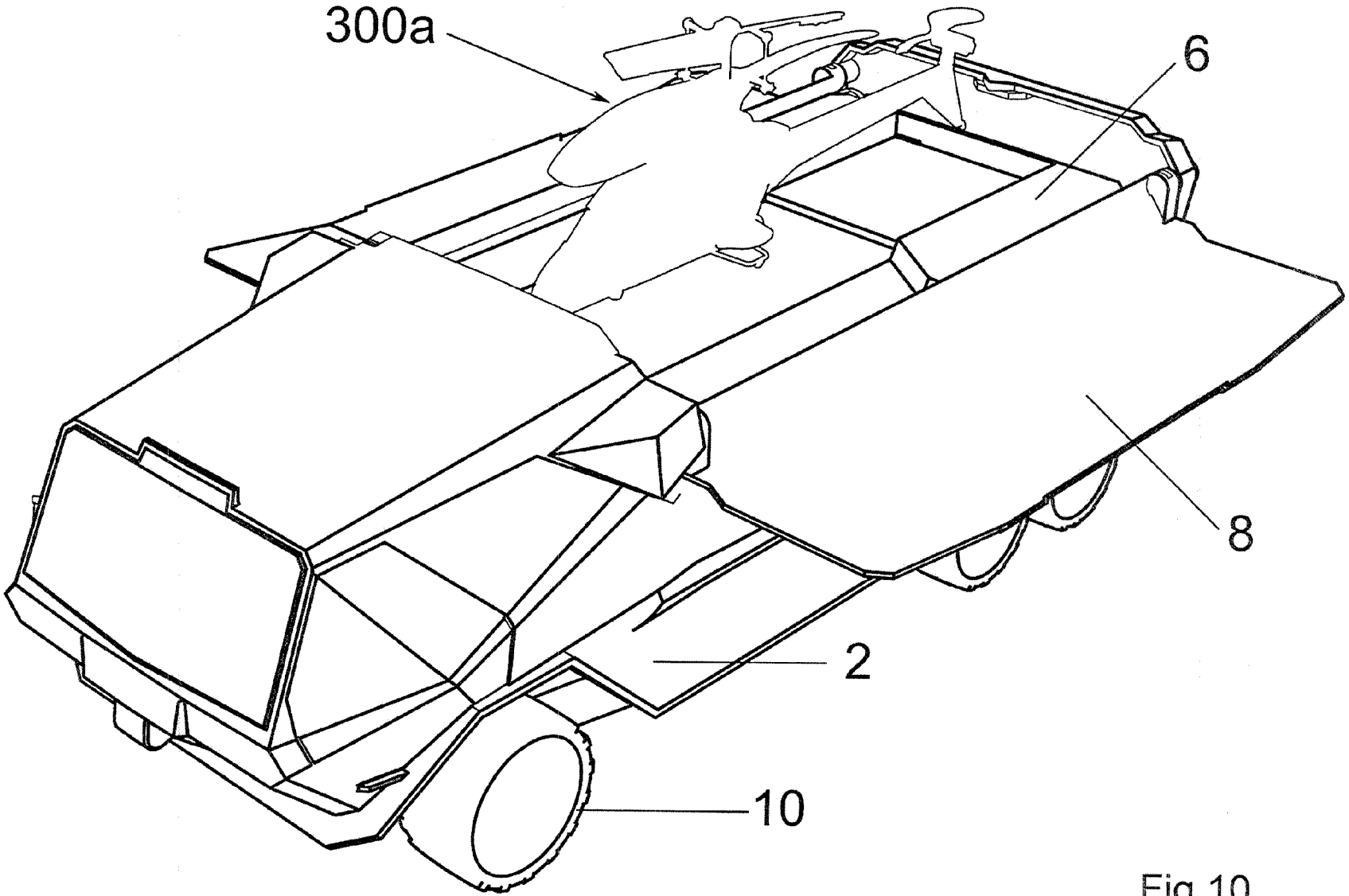
FIG. 10 shows an embodiment of a platform and door assembly for the housing for a remote controlled toy in accordance with the present disclosure.

FIGS. 1-2 show systems including a storage housing 100, an exemplary remote control 200 and exemplary remote control toy flying object 300*a* and remote control toy vehicle 300*b* respectively, showing a communication relationship between the remote control 200 and the remote control toy flying object 300*a* and remote control toy vehicle 300*b*. FIG. 1 shows the remote control toy flying object 300*a* as a helicopter, however, in other examples, there can be a plane or another different flying object such as a UFO and others. FIG. 2 shows the remote control toy vehicle 300*b* as a car, however, in other examples, there can be a truck, tank or another different vehicle such as a motorcycle and others. The housing 100 provides a safe and secure area for storage and transportation of the toy flying object 300*a* or toy vehicle 300*b* which may be fragile.

Referring to FIGS. 2-11, the storage housing 100 is for stowing the remote control toy. The housing 100 comprises a substantially box shaped body 2 with an interior compartment 4. The compartment 4 has a platform 6 for movement between two positions, and a door 8, the door 8 includes two door panels, for moving between an open and closed position. The two positions of the door 8 are respectively shown in FIG. 8 and FIG. 3. The remote controller 200 is for operating the platform 6 and door 8 in a selected manner and also for operating the toy flying object 300*a* or the remote control vehicle 300*b*. The housing 100 is preferably part of a vehicle, such as a truck and can have wheels 10. The housing 100 also has a power source and a second compartment 12 for storing the power source, such as batteries.

The interior compartment 4 of the housing 100 is accessible through the door 8 when the door 8 is in the open position. The door 8 includes two side panels hingedly attached to the body of the housing 100, but can be made of a single door and yet other configurations are possible.

The door 8 is pivotally movable to permit access to the interior compartment 4 by pivotally moving one or more panels of the door 8 to an open position. The platform 6 is operable by a motor 14 for moving the platform 6 upwardly to be substantially flush with the top of the housing 100, or downwardly to be inside of the compartment such that the door 8 is closable over the remote controlled toy. The motor 14 is powered by the power source. The power source can include a connection for connecting the power source to the remote controlled toy to charge a rechargeable battery of the toy.

Figure 12:
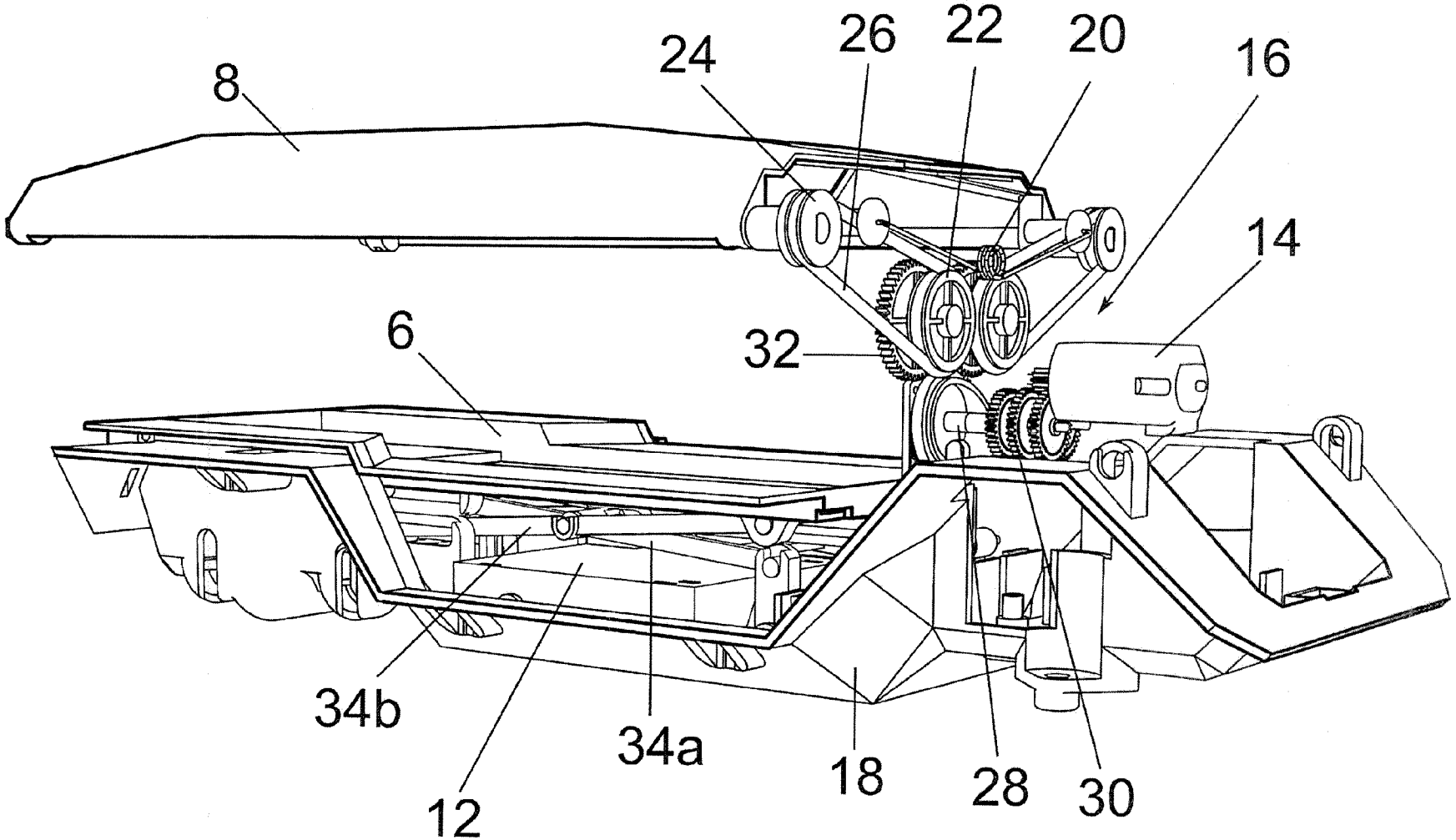
FIG. 12 shows an embodiment of a platform and door assembly for the housing for a remote controlled toy in accordance with the present disclosure.
Figure 13:
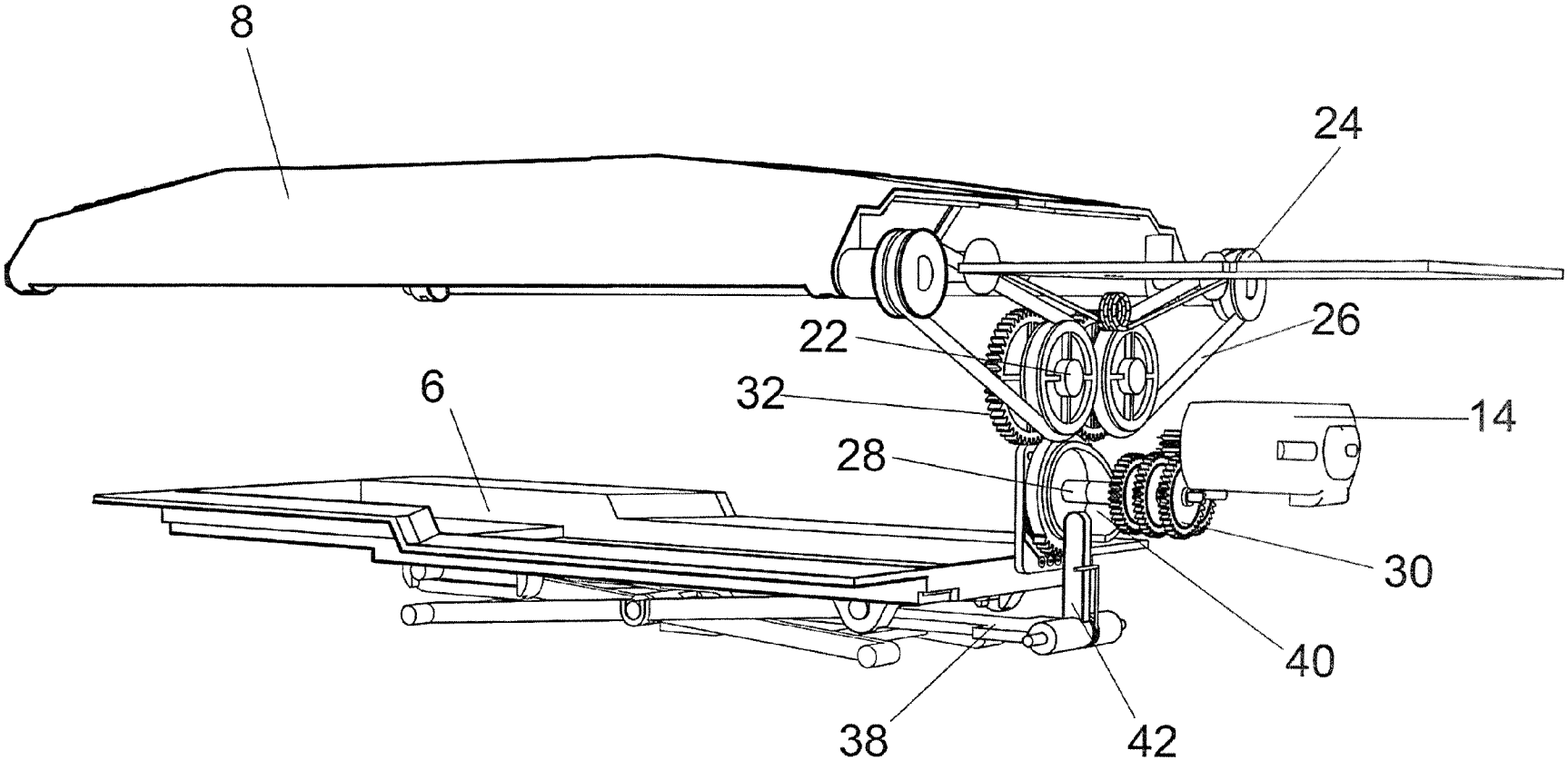
FIG. 13 shows an embodiment of a platform and door assembly for the housing for a remote controlled toy in accordance with the present disclosure.
Figure 14:
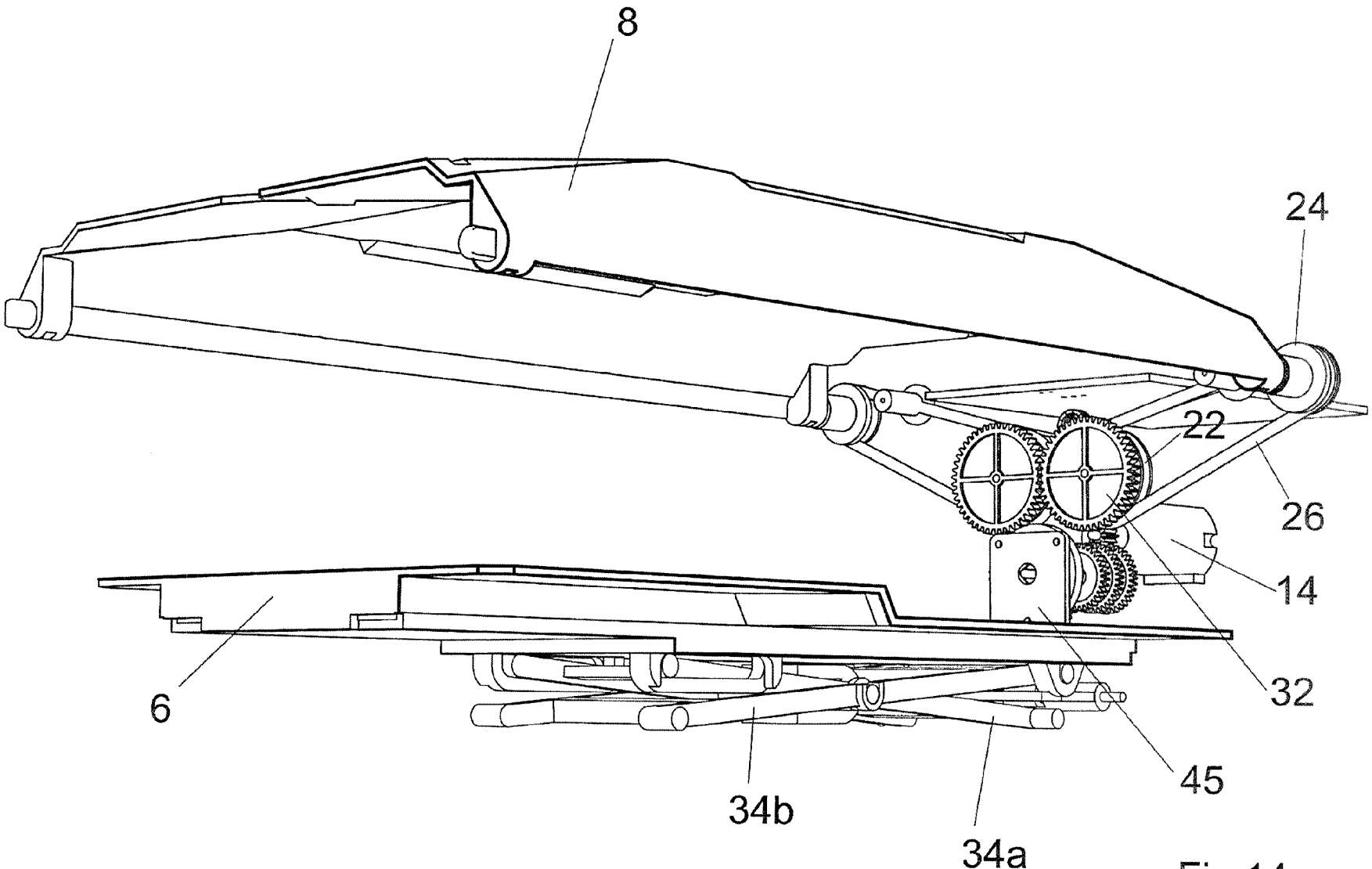
FIG. 14 shows an embodiment of a platform and door assembly for the housing for a remote controlled toy in accordance with the present disclosure.
Figure 15:
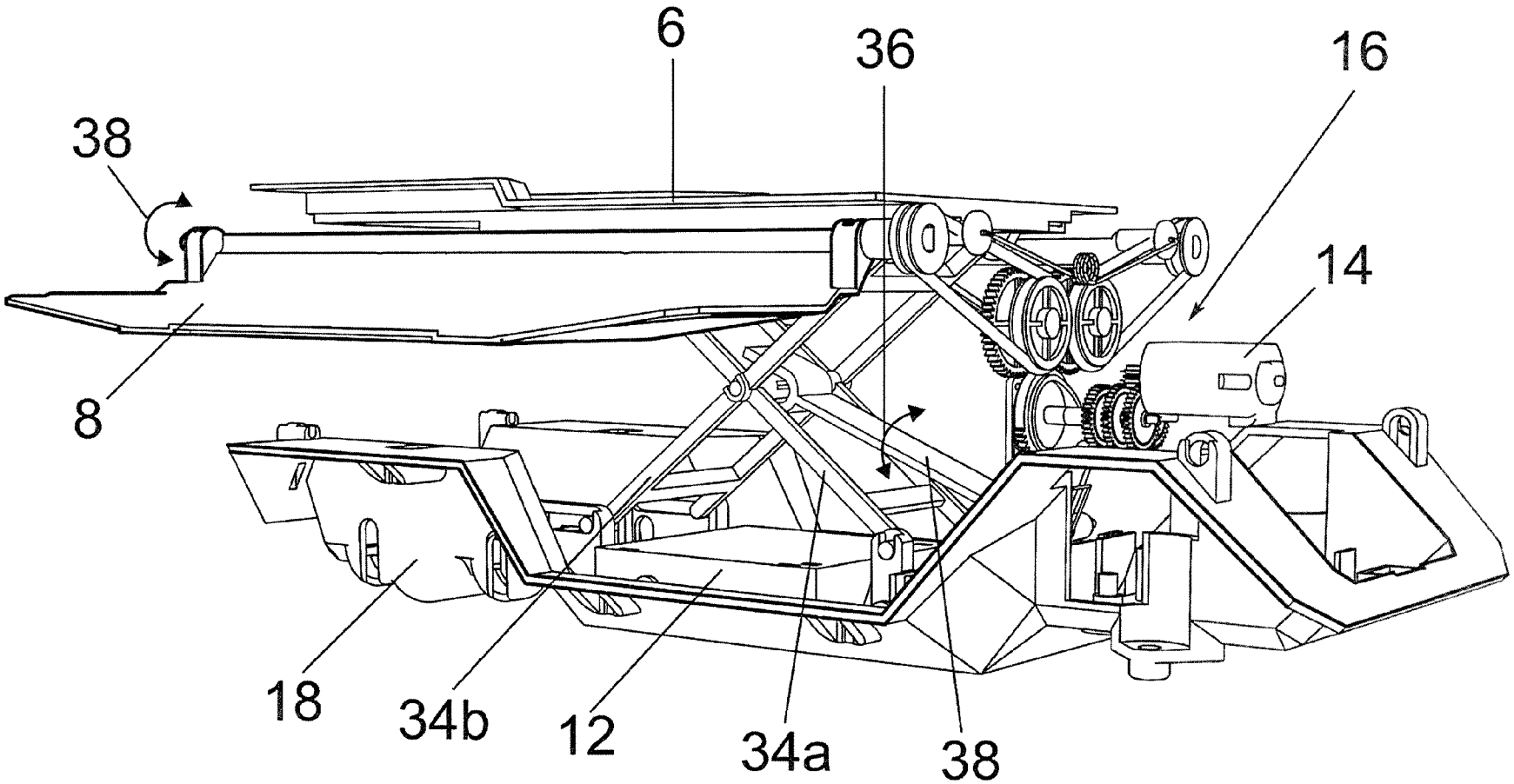
FIG. 15 shows an embodiment of a platform and door assembly for the housing for a remote controlled toy in accordance with the present disclosure.
Figure 16:
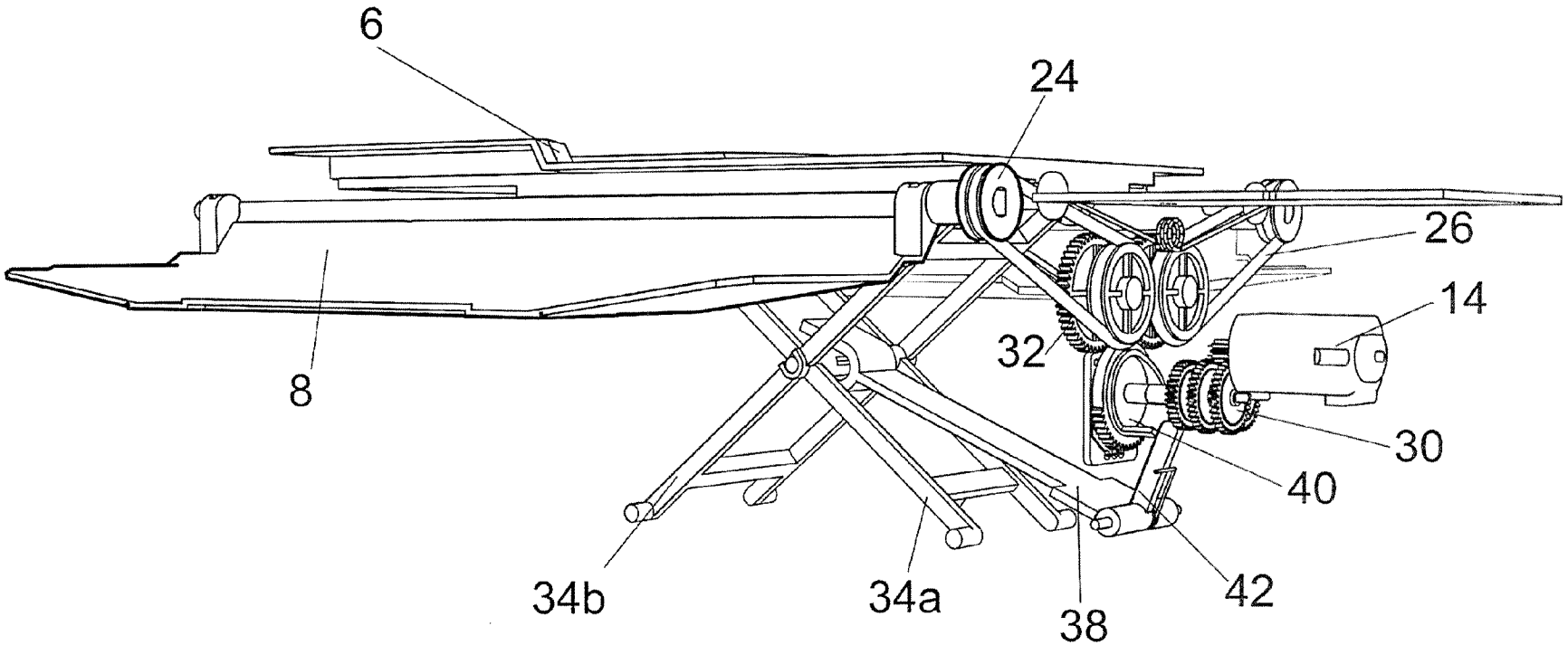
FIG. 16 shows an embodiment of a platform and door assembly for the housing for a remote controlled toy in accordance with the present disclosure.
Figure 17:
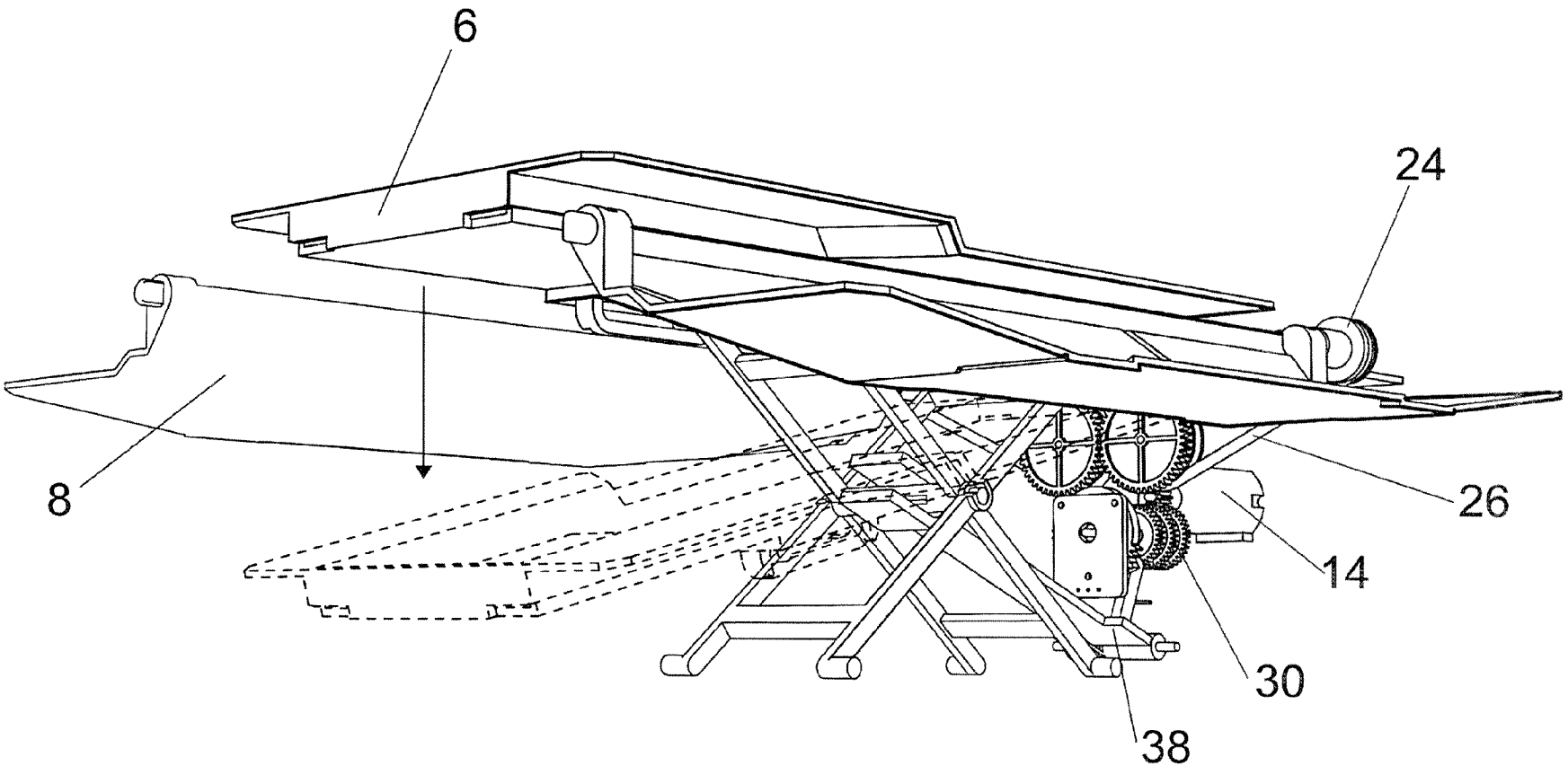
FIG. 17 shows an embodiment of a platform and door assembly for the housing for a remote controlled toy in accordance with the present disclosure.

Referring to FIGS. 12-17, there is a chassis 18 of the housing 100. FIGS. 12-14 show the door 8 in the closed position and the platform 6 in the lowered position for stowing the remote control toy. FIGS. 15-17 show the chassis 18 with the door 8 in the open position and the platform 6 in the raised position for launching or landing in the case of the toy flying object 300*a*. The platform 6 is supported by two legs 34*a* and 34*b* that are configured in a cross configuration, hingedly connected and whereby at least one in slidable relative to the chassis 18 to permit up and down movement of the platform 6 via a lift arm 38. The lift arm 38 can pivot in a direction shown by arrow 36.

Also shown in FIGS. 12-17, there is a system 16 for opening and closing panels of the door 8 and for raising and lowering the platform 6. The system 16 is driven by the motor 14 and comprises of a spring 20, a first set of gears 30, a second set of gears 32, a gear shaft 28, a cam gear 40, a cam follower 42, a first set of pulleys 22, a second set of pulleys 24 and a set of belts 26. Each individual within a set is for operating an individual panel of the door 8.

When the motor 14 turns, it engages the gears 30 that rotate the gear shaft 28. The gear shaft 28 engages the cam gear 40. The cam gear 40 has teeth for engaging the second gears 32. The second gears 32 are connected to and rotate, in the sense of rotation of the gears 32, with the first pulleys 22. The first pulleys 22 engage the belts 26 to rotate the second pulleys 24. Each of the pulleys within the set of pulleys 24 is connected to a panel of the door 8, such that when the pulleys 24 rotate, the panels of the door 8 open if the door 8 is closed or close if the panels of the door 8 are open by hinging around the axis of the respective pulley 24 in the direction denoted by arrow 38. As the cam gear 40 rotates, the cam follower 42 is engaged for raising the lift arm 38 to which the cam follower is in connected engagement with, as shown in FIGS. 13 and 16, thereby to raise or lower the platform 6.

There is a position decoder 45 or sensor as part of a printed circuit board (PCB). The decoder 45 senses a turning angle of gear shaft 28 and hence the position of door 8 and platform 6. In response, the decoder sends a signal reporting the position of the door 8 and platform to a microcomputer for driving the motor 14 accordingly in response to operating commands received from the remote controller 200.

Figure 18:
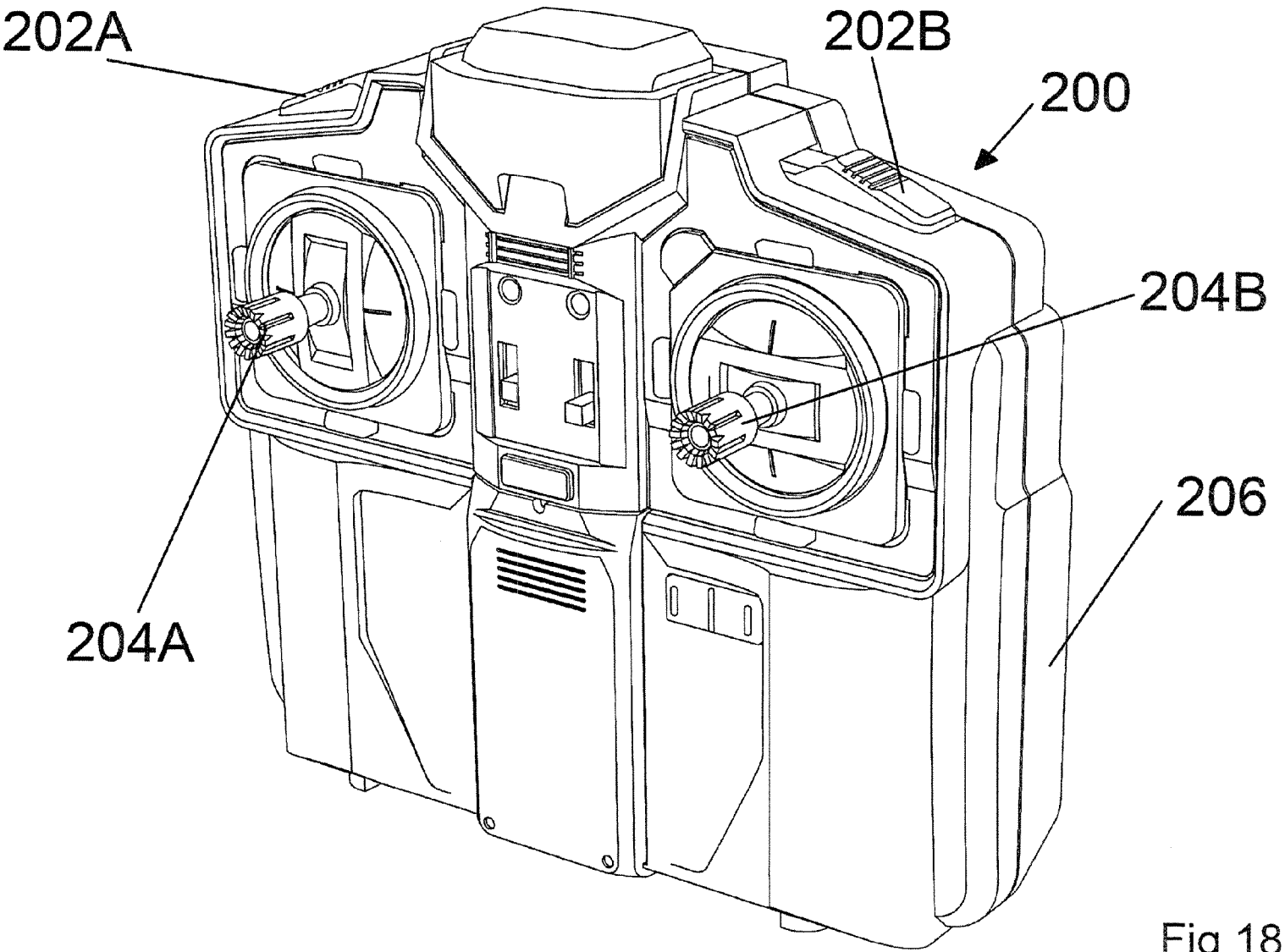
FIG. 18 shows an embodiment of a remote control for a remote controlled flying object and housing in accordance with the present disclosure.

Referring to FIG. 18, the controller 200 includes control elements 202A and 202B for operating the platform 6 and the door 8 and control elements 204A and 204B for controlling the flying object. The control elements 204A and 204B control at least the directional motion of the toy flying object.

The platform 6 and door 8 are operable interdependently or independently in response to one or more controls for the remote controller 200. A user can press control element 202A to toggle open and close the door 8, i.e., press to open and press again to close the door 8 and press control element 202B to lift up and lower the platform 6. If the door 8 is closed, the user can press control element 202B which opens the door 8 and elevates the platform 6. If the platform 6 is already up, in the lifted position, the user can press control element 202A to lower the platform 6 and close the door 8.

The general operational procedure of door 8 and platform 6 described as interdependently and/or independently are as follows:

1. Press button 202A to toggle open and close the door, i.e., press to open and press again to close the door.

2. Press button 202B to toggle lift up and lower the platform.

3. If the door is closed, pressing button 202B can open the door first and then elevate the platform.

4. If the platform is lifted up, pressing button 202A can lower the platform first and then close the door.

The controller 200 includes a first control 202A for selectively toggling the motor 14 in the housing 100 to open or close the door 8. There is also a second control 202B for selectively toggling the motor 14 in the housing 100 to lift up or lower the platform 6.

The controller 200 operates such that when the door 8 is closed, the second control 202B is operable to open the door 8 first and then elevate the platform 6. When the platform 6 is elevated, the first control 202A is operable to lower the platform 6 first and then close the door 8.

The controller 200 includes both the first control 202A and the second control 202B on the body 206 of the remote control transmitter 200, the remote control has further controls for controlling the flying object 300*a*.

In one instance, the controller 200 may further comprise additional controls for remotely controlling forward, backward and turning movements of the housing 100 when the housing 100 is a vehicle. In another instance, the controller 200 may include a switch or button that would allow the controller 200 to switch from driving or operating the vehicle housing 100 to flying or operating the toy flying object 300*a*.

The toy flying object 300*a*, for example, can be a remote control toy helicopter. A remote control toy helicopter comprises a body, a motor and a battery for the motor. The motor is controllable by a controller remote, such as remote control 200, remote from the body. The helicopter has a main rotor with at least two propeller blades. The propeller blades define a plane of rotation of the main rotor. The main rotor is driven by a rotor shaft, on which the propeller blades are mounted. There is a tail rotor driven by a second rotor shaft directed transversely to the rotor shaft of the main rotor and an auxiliary rotor driven by the rotor shaft of the main rotor in the rotational sense of the main rotor. The auxiliary rotor is mounted such that a first longitudinal axis of the auxiliary rotor is situated in an acute angle relative to a second longitudinal axis of one of the propeller blades of the main rotor. The acute angle is determined when viewed from above the plane of rotation. The auxiliary rotor has a further plane of rotation spaced from the plane of rotation of the main rotor. The main rotor and the auxiliary rotor are linked with each other by a mechanical linkage, such that the auxiliary rotor is mounted in a swinging relationship on an oscillatory shaft provided essentially transversally to the rotor shaft of the main rotor. The swinging motion is relatively upwards and downwards around the oscillatory shaft, such that the swinging motion of the auxiliary rotor controls an angle of incidence of the propeller blades of the main rotor. After the door 8 is opened and the platform 6 is in the upward position, the flying object 300*a* can be controlled to take-off from the platform 6 and fly.

The remote control toy is provided with a receiver, so that it can be controlled from a distance by means of remote controller 200. The housing 100 also has a receiver, so that it can be controlled from a distance by means of the remote controller 200 also.

Different wireless remote communication protocols can be used to communicate between the toy flying object 300*a* and the remote control 200 and the housing 100 and the remote control 200. In one example for instance an infrared (IR) data transmission is used. Remote controls use infrared light-emitting diodes (IREDs) to emit infrared radiation. The IREDs point to different directions so as to achieve wide beam for better signal coverage. The beam is modulated, i.e., switched on and off, to encode the data. A receiver in the housing 100 and/or the toy flying object 300*a* may use a silicon photodiode to convert the infrared radiation to an electric current and responds to a rapidly pulsing signal created by the transmitter inside the remote control 200, and filters out slowly changing infrared radiation from ambient light.

The microcomputer and PCB located inside the housing 100 also process signals from an IR receiver within the housing 100, to steer, move the housing 100 forward and backward and operate the system 16 for the door 8 and platform 6 in response to operating commands from the remote controller 200. The microcomputer can also used to generate light and sound effects for the housing 100.

Figure 11:
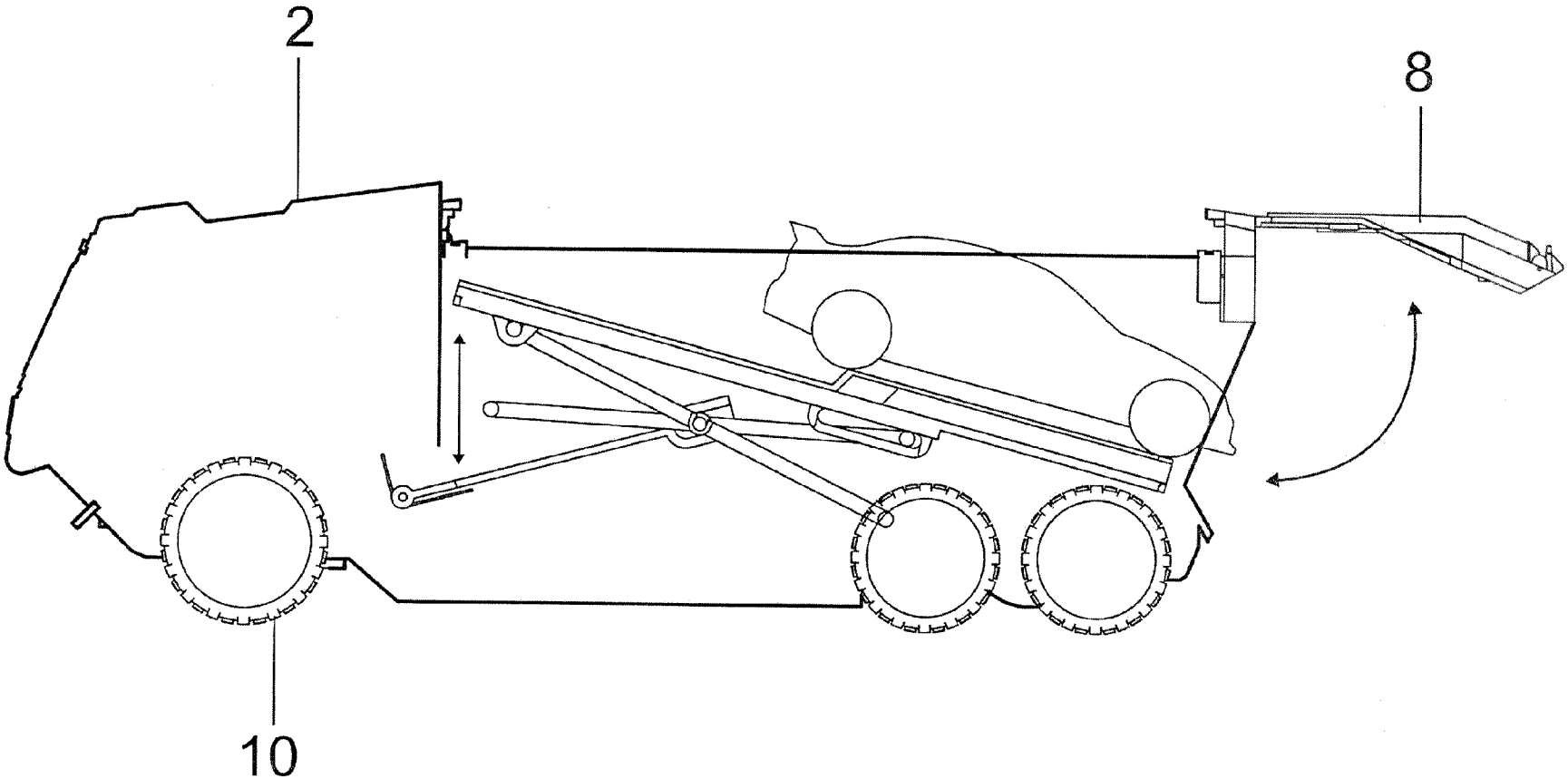
FIG. 11 shows an embodiment of a platform and door assembly for the housing for a remote controlled toy in accordance with the present disclosure.

Referring to FIG. 11, instead of the door 8 panels opening up so that a toy flying object 300*a* can take off from the platform 6, the door 8 can open from the rear of the housing 100, as shown by a directional movement arrow between the door 8 and the rear of the housing 100 in FIG. 11, such that the toy vehicle 300*b*, such as a car, can drive out of the housing 100. The front end of the platform 6 can raise up, as shown by a directional movement arrow between the platform 6 and the lift arm 38 in FIG. 11, resulting in a slanted platform when the user presses the second control 202B. This can allow the toy vehicle 300*b* to come out through the rear door by gravitational force or it can be driven out by the user. The platform 6 may include tread for grip with the tires of the remote control vehicle 300*b*. Additionally, there may be a step on the platform 6 to prevent the remote control vehicle 300*b* from inadvertently rolling down the platform 6 without user instruction.

Thus, in the open position, the door 8 allows the compartment 4 to be accessible from the rear of the housing 100 and the platform 6 is operable by the motor 14 for moving the platform 6 upwardly at one end such that the platform 6 is slanted downwardly, as shown in FIG. 17, for allowing a toy vehicle to roll down the platform 6 and out of the housing 100. In such an instance, the commands on the remote control 200 and the system 16 will continue to operate as described above.

In another instance, the panels of the door 8 can open from the top of the housing 100, as they would for the toy flying object 300*a*, and additionally the rear door can open. The platform 6 can slant for allowing the toy vehicle 300*b* to come out through the rear door of the housing 100 by gravitational force or it can be driven out by the user. In such an instance, the rear door can become part of a ramp from which the toy vehicle 300*b* can roll down to drive around or to roll up for storage and/or transport.

The remote control 200 is substantially rectangular box shaped. The controls 202A and 202B of the remote control 200 are located on an upper portion of the body 206 and the controls 204A and 204B are located on a front face of the body 206.

While the housing for a remote controlled toy has been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. In combination a toy storage housing comprising a remote control toy as a first toy for storing a remote control flying toy as a second toy, the housing comprising a substantially box shaped body with an interior compartment, the interior compartment having a platform for movement between two positions, and a door for moving between an open and closed position for the compartment, and a remote controller for operating the platform and door in a selected manner, and wherein the housing is part of a toy rollable vehicle, the toy vehicle having wheels such as to be movable as a rolling toy truck, and the flying toy being unconnected with the platform so that in its operative state the flying toy is freely removable from the platform to enable it to fly under its own power from a battery with the toy, and wherein the controller includes a first control for selectively toggling a motor in the housing to open or close the door; and a second control for selectively toggling a motor in the housing to lift up or lower the platform, and wherein the controller includes both the first control and the second control on the body of a remote controller, and the controller having further controls for independently controlling the flying object, and wherein the toy truck is operable as a first independent toy and the flying toy object is operable as a second independent toy, and wherein the toys can operate independently and when combined the truck is functional in an integrated manner with the flying toy housed inside the truck.

2. A combination as claimed in claim 1 wherein the platform and door are operable interdependently or independently in response to one or more controls for the remote controller.

3. A combination as claimed in claim 1 wherein the controller includes control elements for operating the platform and the door and control elements for controlling the toy.

4. A combination as claimed in claim 1 wherein control elements for controlling the toy controls at least controlling the directional motion of the toy, and an interior compartment for the body being for stowing the toy when not in use.

5. A combination of claim 1, further comprising a second compartment for batteries.

6. A combination of claim 1, wherein the door is pivotally movable permitting access to the interior compartment by pivotally moving one or more door panels to an open position.

7. A combination of claim 1, wherein the platform is operable by a motor for moving the platform upwardly to be substantially flush with the top of the housing, or downwardly to be inside of the compartment such that the door is closable over the toy.

8. A combination of claim 1 wherein the door is formed by a pair of panels, each respective panel being hinged on a respective opposite edge of the housing, and each panel being movable from the position closing the compartment to the position opening the compartment, the panels in the closed position being substantially flush with free edges of the respective panels being in abutment substantially along a center line of the toy rollable vehicle, the centerline running from the front of the toy rollable vehicle to the area of the toy rollable vehicle and substantially bisecting the toy rollable vehicle, and in the opening position the panels arc outwardly such that the panels extend from the side of the toy rollable vehicle.

9. A combination of claim 8 including a motorized system for opening and closing the door panels, and wherein the motorized system includes a motor, a gearing system and pulleys with pulley belts connecting a first pulley driven by a shaft which is gear connected with the motor and the a second pulley wheel about a hinging shaft on which the respective panels of the door are movable between the open and closed positions.

10. A storage housing for stowing a remote control toy flying object, the housing comprising a substantially box shaped body with an interior compartment, the compartment having a platform for movement between two positions, and a door for moving between an open and closed position for the compartment, and a remote controller for operating the platform and door in a selected manner; the platform and door being operable interdependently or independently in response to one or more controls for the remote controller, the controller including control elements for operating the platform and the door and control elements for controlling the flying object, and a power supply providing power for the remote control and optionally for charging a flying object; and wherein the housing is part of a toy rollable vehicle, the toy vehicle having wheels such as to be movable as a rolling toy truck, and the flying toy being unconnected with the platform so that in its operative state the flying toy is freely removable from the platform to enable it to fly under its own power from a battery with the toy, and wherein the controller includes a first control for selectively toggling a motor in the housing to open or close the door; and a second control for selectively toggling a motor in the housing to lift up or lower the platform, and wherein the controller includes both the first control and the second control on the body of a remote controller, and the controller having further controls for independently controlling the flying object, and wherein the toy truck is operable as a toy.

11. A combination of claim 10 wherein the controller operates such that when the door is closed, the second control is operable to open the door first and then elevate the platform.

12. A combination of claim 10 wherein the controller operates such that when the platform is elevated, the first control is operable to lower the platform first and then close the door.

13. A combination of claim 10 wherein the controller operates such that when the platform is elevated, the first control is operable to lower the platform first and then close the door.

14. A combination of claim 10 wherein the controller includes both the first control and the second control on the body of a remote controller, the controller having further controls for controlling the toy.

15. A storage housing for stowing a remote control toy, the housing comprising a substantially box shaped body with an interior compartment for storing a remote control toy, the compartment having a platform for movement between two positions, and a door for moving between an open and closed position for the compartment, and wherein the housing is part of a toy rollable vehicle, the toy vehicle having wheels such as to be movable as a rolling toy truck, and the remote control toy being unconnected with the platform so that in its operative state the remote control toy is freely removable from the platform to enable it to operate under its own power from a battery with the toy, and a remote controller, wherein the controller includes a first control for selectively toggling a motor in the housing to open or close the door; and a second control for selectively toggling a motor in the housing to lift up or lower the platform, and wherein the controller includes both the first control and the second control on the body of a remote controller, and the controller having further controls for independently controlling the remote control toy and wherein the toy truck is operable as a first independent toy.

16. A housing of claim 15 wherein the door is formed by a pair of panels, each respective panel being hinged on a respective opposite edge of the housing, and each panel being movable from the position closing the compartment to the position opening the compartment, the panels in the closed position being substantially flush with free edges of the respective panels being in abutment substantially along a center line of the toy rollable vehicle, the centerline running from the front of the toy rollable vehicle to the area of the toy rollable vehicle and substantially bisecting the toy rollable vehicle, and in the opening position the panels arc outwardly such that the panels extend from the side of the toy rollable vehicle.

17. A housing of claim 16 including a motorized system for opening and closing the door panels, and wherein the motorized system includes a motor, a gearing system and pulleys with pulley belts connecting a first pulley driven by a shaft which is gear connected with the motor and the a second pulley wheel about a hinging shaft on which the respective panels of the door are movable between the open and closed positions.

18. A housing of claim 16 including a remote controller for operating the platform and door in a selected manner; the platform and door being operable interdependently or independently in response to one or more controls for the remote controller, the controller including control elements for operating the platform and the door and control elements for controlling the toy, and a power supply providing power for the remote control and optionally for charging a toy.

* * * * *